United States Patent [19]

Casey

[11] Patent Number: 5,030,022

[45] Date of Patent: Jul. 9, 1991

[54] RIBBON CARTRIDGE WITH INTEGRAL RE-INKER

[75] Inventor: Don E. Casey, Columbus, Ohio

[73] Assignee: Mando Products, Ltd., Mandeville, La.

[21] Appl. No.: 410,262

[22] Filed: Sep. 21, 1989

[51] Int. Cl.[5] ..... B41J 32/02

[52] U.S. Cl. ..... 400/194; 400/195; 400/202.4; 400/234

[58] Field of Search ..... 400/194, 195, 196, 202.2, 400/202.4, 234, 235, 235.1

[56] References Cited

U.S. PATENT DOCUMENTS

| | | | |
|---|---|---|---|
| 2,760,464 | 8/1956 | Roggenburger | 400/202.4 |
| 3,621,968 | 11/1971 | Kondur, Jr. | 400/195 |
| 3,887,727 | 6/1975 | Ploeger, Jr. et al. | 400/202.2 |
| 3,951,253 | 4/1976 | Tibay et al. | 404/202.4 |
| 4,037,709 | 9/1975 | Tibay | 400/202.2 |
| 4,074,800 | 2/1978 | Steinke | 400/195 |
| 4,227,820 | 10/1980 | Falcetti | 400/195 |
| 4,469,456 | 9/1984 | Fitzgerald | 400/194 |
| 4,536,098 | 8/1985 | Sheehan et al. | 400/202.4 |
| 4,636,097 | 1/1987 | Goubeaux | 400/202.4 |
| 4,838,715 | 6/1989 | Ishikawa | 400/202.4 |

*Primary Examiner*—Edgar S. Burr
*Assistant Examiner*—Ren Yan
*Attorney, Agent, or Firm*—Raymond G. Areaux

[57] ABSTRACT

A re-inkable ribbon cartridge for impact computer printers featuring duel re-inking rollers of sufficiently small diameter so as to insure rapid rotational speed, ensuring that centrifugal force will cause the ink to migrate to the outer roller surface. A single re-inking port axially positioned over each of the two rollers, permitting rapid, single-point re-inking, when needed.

A radially rotational plate on which the blotting rollers are positioned which by spring tension moves so as to keep the ribbon taut.

A two-member parallel dam with the surface of each dam component at over-lapping elevations so as to provide two surfaces to act as an unfurling structure.

2 Claims, 1 Drawing Sheet

RIBBON CARTRIDGE WITH INTEGRAL RE-INKER

BACKGROUND OF THE INVENTION

This invention relates to the design area of cartridges used in typewriters or impact printers, for all applications.

It is estimated that there are fifteen to twenty million computer printers in the hands of personal and business users as of Aug., 1989, with five million additional units being sold each year. This new cartridge design will fit forty models presently on the market, produced by eight manufacturers, exceeding twelve million units.

Typical computer printers (the primary market), have an enclosed plastic ribbon cartridge with the ribbon usually made of Nylon, of 3 to 5 mills thickness, which is inked initially at the factory to a saturation level of 17% to 18% percent. Said looped ribbons are usually between twenty five and forty two point five feet in length, and produce acceptably dark print when new, but gradually fade out during their practical life span, which does not exceed eighty to one hundred single-spaced pages. This means that lengthy documents will be unacceptable in print density, since the printout is progressively lighter with each succeeding page, which a flip-through of the pages dramatically demonstrates.

Several design attempts have been made to solve this gradual fade-out problem, with mixed results. Notable is the external re-inker device which requires the removal of the cartridge from the printer, letting it run on this device for a period of thirty minutes, to achieve a reasonably uniform distribution of ink, with the user having to wear gloves to keep the ink off their hands and clothing.

Other units have the re-inker built into the cartridge by employing a square or rectangular felt or open-celled foam rubber pad, with a short wick to draw the ink, by capillary action, from the pad onto a roller, that in turn transfers it onto the passing ribbon. However, this pad arrangement must be inked to near saturation before the capillary action functions, and the particulant in the ink (coloring agent) causes the cells of the rubber, or the passageways of the felt, to partially or completely clog. Thus—capillary action, alone, is insufficient to do the job. Also, when this pad is inked, the ink, over time, will settle down to and out of the bottom of the pad, eventually causing the cartridge to leak ink through the drive-gear hole or the opening in which the passive gear yoke resides.

This new design, market tested for ten months, overcomes the above described problems with a short, continuous, Mobius looped ribbon, consisting of a 180 degree twist before it is seamed together. This invention provides solutions to the above problems by having one or more built in re-inking rollers, with a re-inking access hole(s) axially centered over these re-inking rollers so that the user can re-ink or add a shot of lighter fluid to the cartridge symmetrically, at the roller's center, whenever ink or lighter fluid is needed, without the design permitting an build-up at the spot where the ribbon rests against the rollers when the printer is not in use. This last, important feature, made practical by a tension spring of a precise compresion value, will be described further in this document.

OBJECTIVES OF THIS INVENTION

The principal objective of this invention is to utilize a short ribbon that will give the manufacturer a choice of offering the cartridge in a deluxe version lasting ten or twelve times longer than a conventional ribbon (defined above), by having one or more re-inking access holes on the top of the cartridge, permitting the user to re-ink the ribbon from a bottle of matrix ink supplied by the manufacturer, or with lighter fluid supplied by the user, at less cost than the manufacture of a conventional ribbon cartridge.

And, to permit the manufacturer to offer this cartridge with only one or two re-inking rollers inside the case (with or without re-inking access holes on top of the case), and use injection molded plastic rollers on the other pins so as to reduce cost of those rollers to about one cent each. This assembly arrangement will permit this cartridge to cost much less than conventional cartridges.

To have, in addition to the re-inking rollers (particularly for the deluxe model) several rollers of the same porous quality "down-stream," which will act as blotter-rollers to absorb any excess ink that the user may add to the re-inkable rollers, and thereby to the ribbon, to prevent the ribbon from becoming grossly over inked.

To provide a Mobius loop in this short ribbon, and most important, a practical means of preventing said Mobius loop from leaving its assigned roll-over point—at the dam. To be specific, a complex "dam " that will prevent the ribbon from folding double—lengthwise—which is a common problem with all such cartridges that have no specific means to prevent fold-over or to prevent the loop from leaving its assigned point and traveling around the ribbon circuit, causing total cartridge failure, usually when it passes the drive gears or rollers, by passing under or over said gears/rollers.

To Permit the manufacturer, without expensive tooling modifications, to offer the same basic cartridge, without the re-inking access holes on the top, and with cored-out plastic rollers "downstream" from the re-inking rollers, so as to reduce the cost the of the unit, making it muchless costly to manufacture than the conventional, short-ribboned (25-30 foot) versions, while offering a comparable life span.

These and other objectives of this invention will become apparent from a description of preferred embodiments herein, and from the drawings and claims, which will further clarify the design scope.

DESCRIPTION OF PREFERRED EMBODIMENTS.

Figure 1:
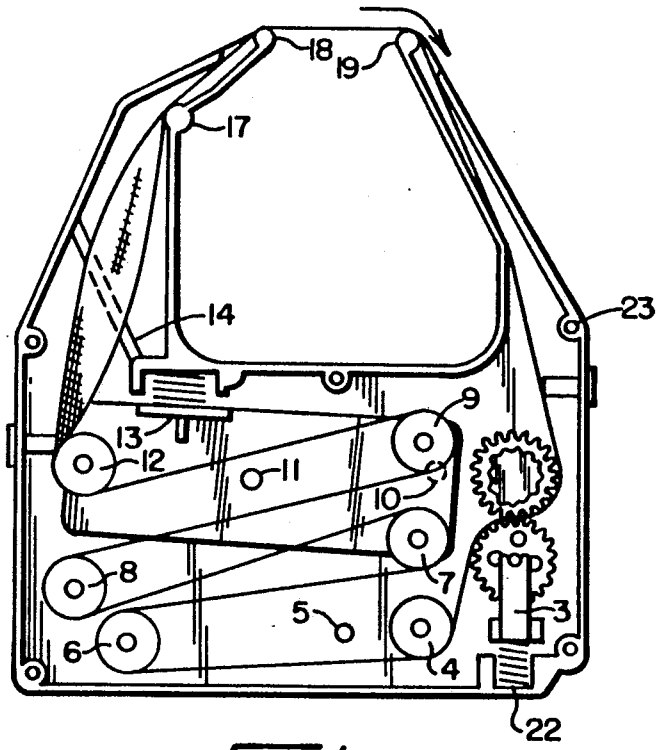
FIG. 1 is a top view of this endless printing ribbon.
Figure 2:
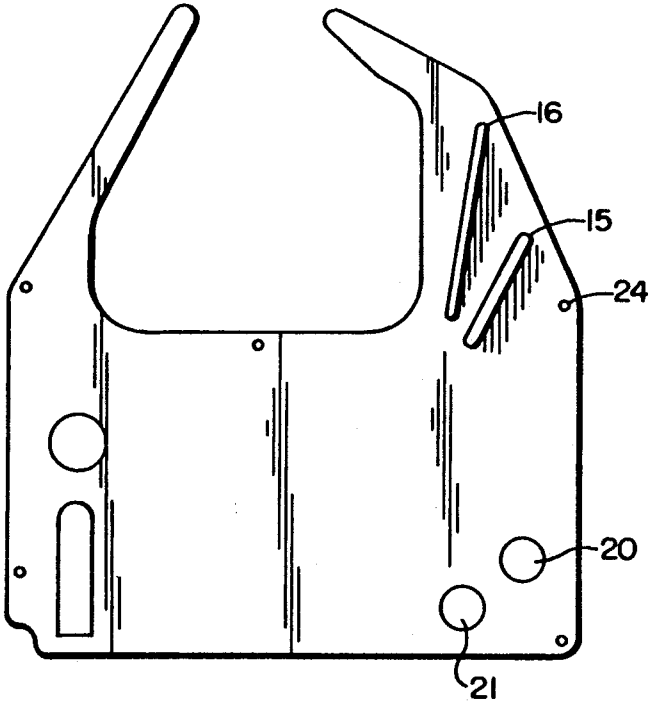
FIG. 2 is a view of the underside of the top of this ribbon cartridge, showing the multipart construction of the dam that is injection molded as an integral part of the top (lid) of the cartridge.
Figure 3:
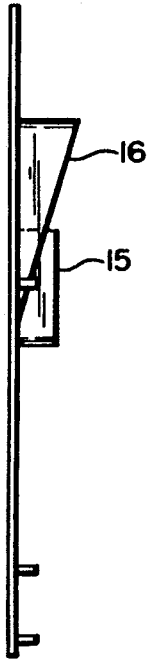
FIG. 3 is an end view of the cartridge top, showing the two dam components on the underside of the cartridge top, and showing the angle of the non-parallel dam component (third part), designed to prevent the ribbon from folding lengthwise after it passes the first two, parallel components of the dam.
Figure 4:
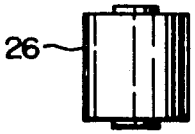
FIG. 4 is an enlarged drawing of cored-out rollers, with an elevated center or hub portion, designed to keep roller contact with the case or the tension plate to a minimum, to reduce friction.
Figure 5:
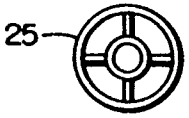

FIG. 1: Numeral 1 shows the drive gear with sufficient teeth to render them to be nearly parallel with adjacent teeth, and with sufficient tooth depth so that both the drive gear will get a good grip on the ink-soaked ribbon, so as to prevent the gear from shipping, even when the user has grossly over-inked the ribbon. 2 is the passive gear, featuring like teeth, and is held against the drive gear with a gear yoke 3, said engagement pressure is provided by a compression spring 22. After leaving the two gears, the ribbon moves in a clockwise direction to the first roller 4, which is positioned on the first roller pin, though the roller may be placed on the second pin 5, if the ribbon should be seamed together too short. In cases where the ribbon has been seamed together too long, an additional roller may be placed on pin 5 and the ribbon threaded in front of that roller, so as to increase the total path of the ribbon. From position 4 or 5, the ribbon proceeds to roller 6 which is the preferred roller position of the re-inking roller, (should the manufacturer prefer to use only one inking roller), since this will mean that all the downstream rollers will act as blotter rollers in cartride models where the manufacturer leaves the top re-inking access hole open for the user to add ink or a solvent to extend ribbon life (Ronson lighter fluid, preferably). Note that the percent of ribbon that is in contact with the roller is maximized for two reasons: First, it greatly increases the exposure time that the ribbon is in contact with the roller during each pass, thus increasing the likelihood that some ink will be transferred onto the ribbon. And secondly, it enables the ribbon to press much tighter against the roller since the ribbon is doing a turn-around, changing direction at that point, which means it is being pulled against the opposite side of the roller. After passing 6 the ribbon traverses to roller 7, the first roller positioned on the pivoting Tension Plate. From there, it doubles back, after making contact with over half of the roller's surface, to the second re-inking roller 8 where the ribbon again makes contact with the second re-inking roller, then proceeds back upon the Tension Plate to roller 9. Note that a hinging pin 10 is shown as shown as being on the underside of the Tension Plate, permitting said plate to have angular rotation relative to that pin. Next, the ribbon contacts roller 12. Said rollers on the Tension Plate receive angular motive force from a compression spring 13, trapped in a spring pocket. Note, that an extra pin 11 is provided on the Tension Plate, in case the manufacturer wishes to use a shorter ribbon, by skipping pin 9, going directly from 8 to a roller that might be positioned on pin 11, and on to pin 12. Upon leaving roller 12, the ribbon rotates 180 degrees as it approaches the Dam 14/15, which consists of two parallel injection molded parts, one extending up from the bottom of the case, the other extending down from the underside of the lid, shown in FIG. 2. A third component of the total Dam consists of 16 (shown in FIG. 2 and 3), which is a dam set at a non-parallel angle to 14 and 15, and with a downward slope from the top of the case, with a matching dam, of the same design on the "upstream" side of component parts (14 and 15), (this dam component is not shown).

After the ribbon rotates 180 degrees, it passes point 17, then passes the open area of the cartridge, where it is struck by the actual print mechanism of the printing device, then traverses past 19 and proceeds in a fairly straight path until it arrives at the drive gear 1, which completes a cycle of the ribbon.

The materials recommended for use in this cartridge are: ABS "T" grade plastic for the case and interior plastic parts. The rollers can be made from surgical grade felt of a specific, tested density, however, open-cell foam rubber is preferred, of a certain density. The ribbon should be of 3 or 4 mill thickness Nylon, though other materials can be compared for durability. And because this ribbon is short and completes a cycle frequently, the seam should be made by a seamer machine that will eliminate the residual ribbon end that is present on seamed together loops. The most desirable ribbon is one woven as a continuous loop, one of which is made in the U.S., though it is not made with a Mobius twist at this time.

While the above mentioned specifications describe the preferred embodiments, some changes can be made in the design, without falling outside the scope of this invention: said variations will be obvious to one familiar and skilled within this design area.

I claim:

1. An endless ribbon cartridge for impact printers comprising in combination:

a housing having a bottom and a plurality of sides and formed to include a pair of protruding arms;

a top cover attached to said housing;

at least one re-inking roller rotatably mounted on said bottom of the housing for continuously re-inking said ribbon, said top cover having a re-inking access hole axially centered over said re-inking roller;

ribbon drive means including a drive gear wheel and a driven gear wheel disposed in said housing for driving said ribbon in between them over a predetermined path between said protruding arms and said re-inking roller;

a pin fixedly disposed on said bottom;

a self-tensioning plate pivotally mounted on said pin at one side and having at least two guide rollers rotatably mounted thereon;

said ribbon being wrapped through said re-inking and said guide rollers and contacting said rollers for at least ninety degrees;

a compression spring disposed adjacent one side of said self-tensioning plate for biasing said self-tensioning plate pivotally about said pin to tension the ribbon such that the entire length of said ribbon is under tension;

a pair of parallel dams disposed in the housing downstream of said self-tensioning plate for maintaining a mobius loop of said ribbon, one of said dams extending from the bottom and the other extending from the top cover, said dams being placed a predetermined distance apart, with the one extending from the top cover extending lower in the housing than the top of the one extending from the bottom so as to prevent said ribbon from folding lengthwise.

2. Endless ribbon cartridge based on claim 1 further comprising additional roller positioning pins disposed on said self-tensioning plate and said bottom so that said rollers can be moved to different positions to accomodate a ribbon of varying length.

* * * * *